US005220957A

United States Patent [19]

Hance

[11] Patent Number: 5,220,957

[45] Date of Patent: Jun. 22, 1993

[54] TUBE SHIELD INSTALLATION USING LUGS AND SLOTS

[75] Inventor: Carl L. Hance, 8225 Mobile Ave., Elberta, Ala. 36530

[73] Assignees: Carl L. Hance, Elberta, Ala.; Thomas J. Tyler, Pensacola, Fla.

[21] Appl. No.: 894,609

[22] Filed: Jun. 5, 1992

[51] Int. Cl.[5] ..... F28F 19/00

[52] U.S. Cl. ..... 165/134.1; 122/DIG. 13

[58] Field of Search ..... 165/134.1; 122/DIG. 13; 138/110; 428/596, 599

[56] References Cited

U.S. PATENT DOCUMENTS

| | | | |
|---|---|---|---|
| 2,646,818 | 7/1953 | Bimpson | 165/134.1 X |
| 4,228,978 | 10/1980 | Rand | 248/49 |
| 4,619,314 | 10/1986 | Shimoda | 165/104.16 |
| 4,776,790 | 10/1988 | Woodruff | 432/233 |
| 5,154,648 | 10/1992 | Buckshaw | 165/134.1 |

*Primary Examiner*—Allen J. Flanigan
*Attorney, Agent, or Firm*—Mason, Fenwick & Lawrence

[57] ABSTRACT

A tube and tube shield assembly comprises a cylindrical tube having a lug extending radially therefrom and a tube shield. The tube shield includes a semi-cylindrical shield member having a diameter substantially equal to that of the tube, the shield member having a slot formed therein for receiving the lug, and a retainer for retaining the shield member in engagement around the tube. The tube shield has an upper end and a lower end, and the slot is formed either extending inwardly of the lower end, for use with vertically-oriented tubes, or the tube shield has the slot formed intermediate its ends, for use with horizontally-oriented tubes. The retainer can comprise at least two U-shaped straps, each of the straps having opposed ends attached, for example by welding, to the tube shield.

15 Claims, 3 Drawing Sheets

TUBE SHIELD INSTALLATION USING LUGS AND SLOTS

BACKGROUND OF THE INVENTION

1. Field of the Invention

The present invention relates to tube shields for use in power and recovery boilers. More specifically, the invention relates to a method and apparatus for attaching tube shields to the tubes of a power or recovery boiler which will prevent rotation and axial slippage of the tube shields with respect to the tubes.

2. Related Art

Soot blowers are high-pressure steam blowers used to remove excessive soot and ash which form in the furnace portion of a boiler. As shown in FIGS. 7 and 8, the boiler tube assemblies 100 used in power and recovery boilers commonly incorporate passageways to accommodate travel of a soot-blower lance 200 for the cleaning of soot and ash from the boiler. Tube shields 110 are installed on those tubes 120 which are affected by soot blower cleaning and high pressure boiler turbulence.

Presently, there are three common systems in use for attaching tube shields to the boiler tubes, as illustrated in FIGS. 1–6. The first of these systems is the U-bolt system, shown in FIGS. 1 and 4. In the U-bolt system, the tube shields 110*a* are formed to cover approximately half of the circumference of the tubes 120. For each tube shield, the closed portion of two U-bolts 130 is placed around the uncovered portion of tube 120 adjacent the ends of the tube shield 110*a*, and two flat bars 132 with holes at each end are placed over the threaded ends of U-bolts 130. Nuts 134 are then screwed onto the threaded ends of U-bolts 130, securing the tube shield 110*a* to tube 120.

Once tube shields 110*a* have been installed using the U-bolt system, and the boiler is placed in service, the temperature fluctuations inside the boiler cause the tube assemblies to expand and contract, resulting in loosening of the nuts. As a result, tube shields 110*a* and U-bolts 130 tend to rotate or slip axially with respect to tubes 120.

The second system is the snap system, illustrated in FIGS. 2 and 5. In this system, the tube shields 110*b* are formed to cover approximately two-thirds of the circumference of the tubes 120, and are bent to have a slightly smaller radius than tubes 120, allowing them to be snapped onto tubes 120. As with the U-bolt system, once tube shields 110*b* have been installed and the boiler is placed in service, the temperature fluctuations inside the boiler cause the tube assemblies to expand and contract, resulting in loosening of snapped-on tube shields 110*b*, rotation and axial slippage.

The third system is the welded U-strap system, illustrated in FIGS. 3 and 6. In this system, the tube shields 110*c* are formed to cover approximately half of the circumference of the tubes 120. One-inch wide strips 140 are rolled around the uncovered portion of tube 120 adjacent the ends of tube shield 110*c*, are lapped over the edges of tube shield 110*c*, and are welded in place. Once tube shields 110*c* have been installed, and the boiler has been placed in service, the high temperature in the boiler and tubes 120 causes strips 140 to expand with tubes 120. However, when tubes 120 contract, straps 140 do not, again resulting in loosening of tube shields 110*c*, rotation, and axial slippage.

A fourth system is disclosed in U.S. Pat. No. 4,619,314 to Shimoda. In this system, a tube is provided with a semi-cylindrical protector which is formed with pairs of projections 4 and 5 which extend beyond the tube and which receive pins 8 and 9. Studs 13 are welded to the tube adjacent the inner surfaces of projections 4 and 5 to prevent rotation and axial displacement of the protector with respect to the tube. Although this system overcomes the rotation and slippage problems of the preceding three systems, it requires the provision of numerous pins for each protector.

It is the solution of these problems to which the present invention is directed.

SUMMARY OF THE INVENTION

It is therefore a primary object of the present invention to provide a tube and tube shield assembly in which the tube shield experiences no or very limited rotation and axial slippage with respect to the tube on which it is installed.

It is another object of the present invention to provide a tube and tube shield assembly usable with either horizontally or vertically oriented tubes.

These and other objects of the invention are achieved by the provision of a tube and tube shield assembly comprising a cylindrical tube having a lug extending radially therefrom and a tube shield. The tube shield includes a semi-cylindrical shield member having a diameter substantially equal to that of the tube, the shield member having a slot formed therein for receiving the lug, and a retainer for retaining the shield member in engagement around the tube.

The tube shield has an upper end and a lower end, and the slot is formed either extending inwardly of the lower end, for use with vertically-oriented tubes, or the tube shield has the slot formed intermediate its ends, for use with horizontally-oriented tubes.

In one aspect of the invention, the retainer comprises at least two U-shaped straps, each of the straps having opposed ends attached, for example by welding, to the tube shield.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
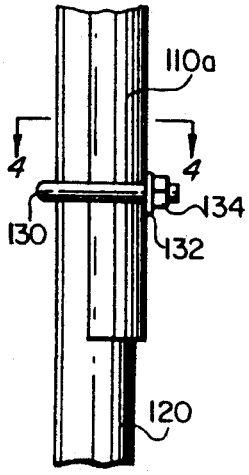
FIG. 1 PRIOR ART
FIG. 1 is a side elevational view of a first prior art tube shield system.
Figure 2:
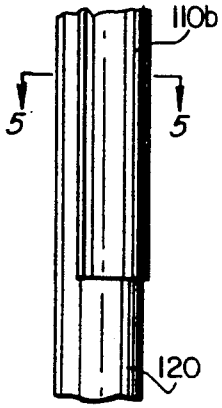
FIG. 2 PRIOR ART
FIG. 2 is a side elevational view of a second prior art tube shield system.
Figure 3:
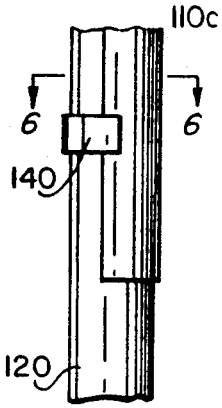
FIG. 3 PRIOR ART
FIG. 3 is a side elevational view of a third prior art tube shield system.
Figure 4:
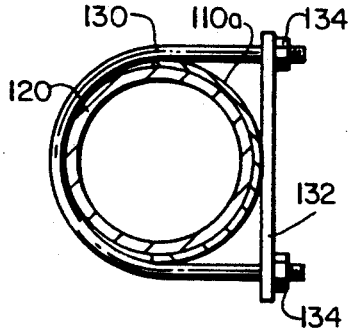
FIG. 4 PRIOR ART
FIG. 4 is a cross-sectional view taken along line 4—4 of FIG. 1.
Figure 5:
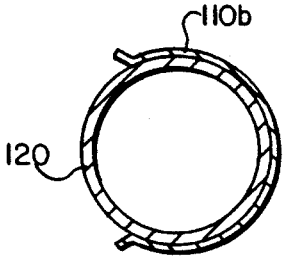
FIG. 5 PRIOR ART
FIG. 5 is a cross-sectional view taken along line 5—5 of FIG. 2.
Figure 6:
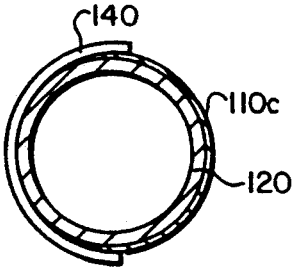
FIG. 6 PRIOR ART
FIG. 6 is a cross-sectional view taken along line 6—6 of FIG. 3.
Figure 7:
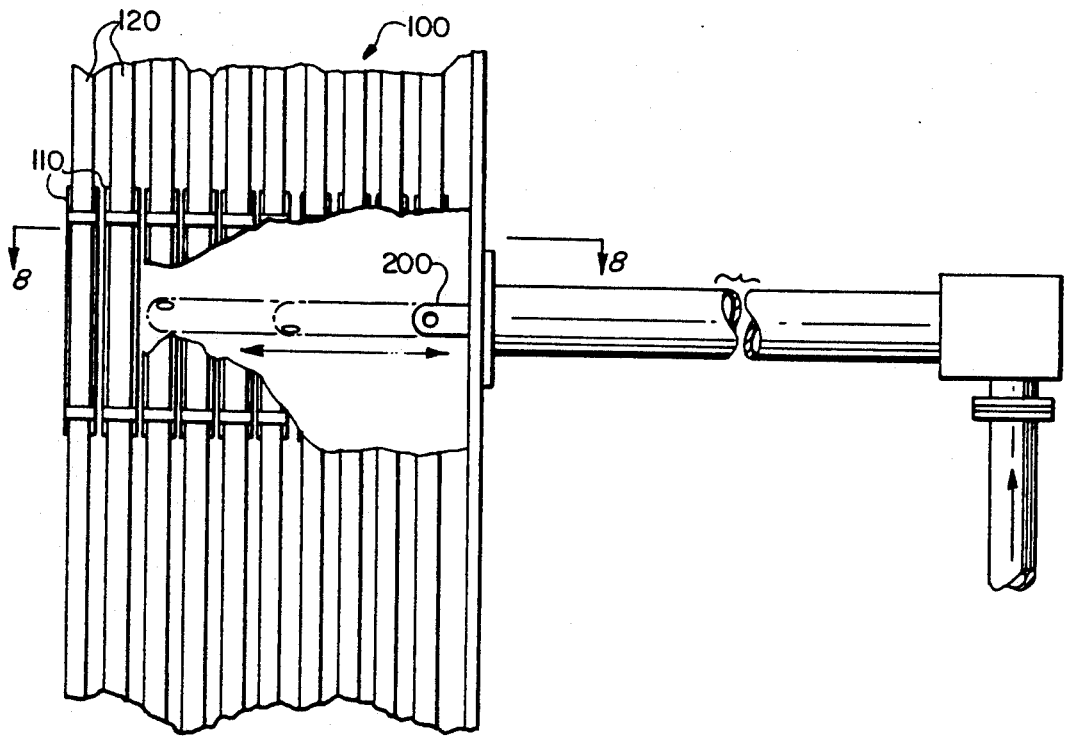
FIG. 7 is a top plan view of a portion of a boiler tube assembly and a soot-blower lance for cleaning the assembly.
Figure 8:
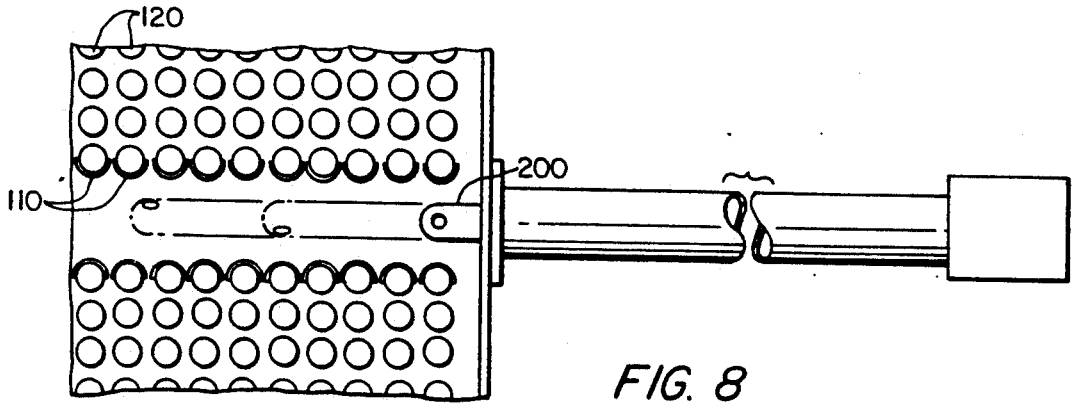
FIG. 8 is a cross-sectional view taken along line 8—8 of FIG. 7.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 9:
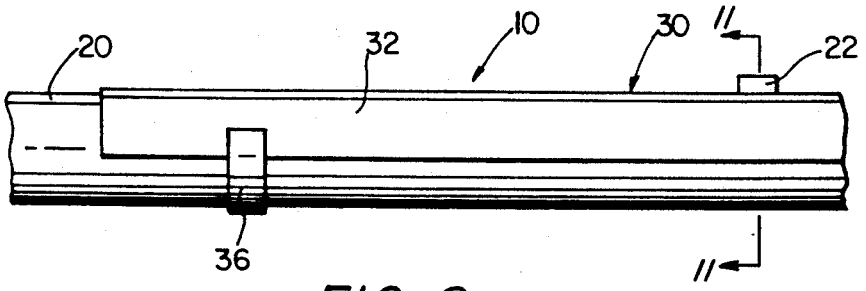
FIG. 9 is a side elevational view of a first embodiment of a tube and tube shield assembly in accordance with the present invention.
Figure 10:
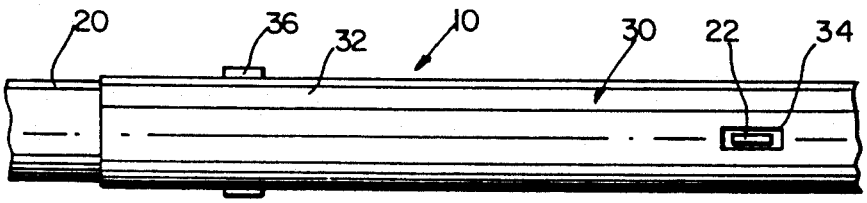
FIG. 10 is a top plan view of the tube and tube shield assembly of FIG. 9.
Figure 11:
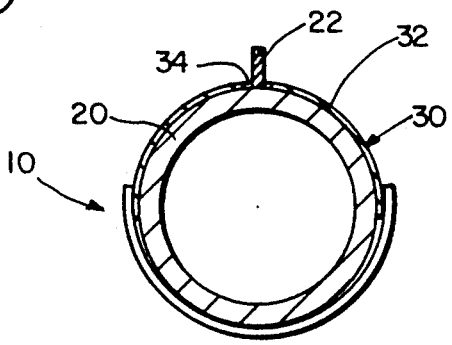
FIG. 11 is a cross-sectional view taken along line 11—11 of FIG. 9.

Referring now to FIGS. 9-11, there is shown a first embodiment of a tube and tube shield assembly 10 in accordance with the present invention. Tube and tube shield assembly 10 comprises a cylindrical tube 20 having a lug 22 extending radially therefrom and a tube shield 30. Tube shield 30 includes a semi-cylindrical shield member 32 having a slot 34 formed therein for receiving lug 22 and a retainer 36 at either end of shield member 32 for retaining shield member 32 in engagement around tube 20.

Shield member 32 covers approximately one-half of the circumference of tube 20, and has substantially the same radius as tube 20.

Preferably, each retainer 36 comprises a metal strap rolled around the unshielded portion of tube 20 and overlapping the side edges of shield member 32 and welded thereto as in the prior art.

Tube 20 shown in FIGS. 9-11 is a horizontally-oriented tube. For use with such a horizontally-oriented tube, slot 34 is positioned intermediate the ends of shield member 32. By "intermediate" is meant a position anywhere between the ends of shield member 32, not limited to the point at the middle of shield member 32. Slot 34 is sized slightly larger than lug 22 to allow for relatively easy insertion of lug 22 into slot 34, but is small enough to prevent any significant rotational or axial movement of shield member 32 with respect to tube 20.

Figure 12:
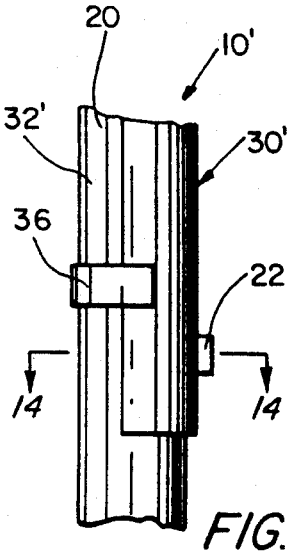
FIG. 12 is a side elevational view of a second embodiment of a tube and tube shield assembly in accordance with the present invention.
Figure 13:
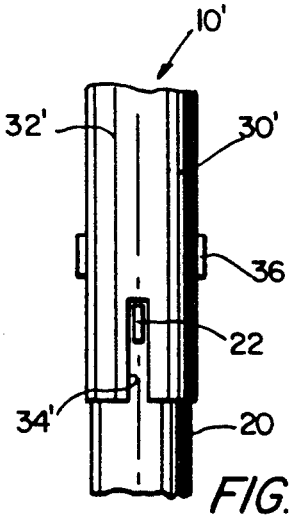
FIG. 13 is a top plan view of the tube and tube shield assembly of FIG. 12.
Figure 14:
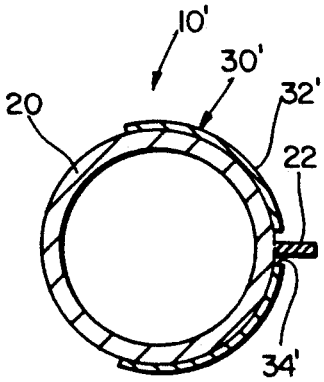
FIG. 14 is a cross-sectional view taken along line 1414 of FIG. 12.

Referring now to FIGS. 12-14, there si shown a second embodiment of a tube and tube shield assembly 10' for use with a vertically-oriented tube 20. Tube shield 30' is similar to tube shield 30, except that, due to the vertical orientation of tube 20, a slot 34' is formed at the lower end of shield member 32'.

As with slot 34, slot 34' is sized to permit easy insertion of lug 22 therein while preventing any significant rotational or axial movement of shield member 32' with respect to tube 20.

As will be appreciated by those of ordinary skill, the materials to be used for tubes 20 and 20', and for tube shields 30 and 30' will be those which are compatible with the heat characteristics of the boiler in which they are to be installed; and the dimensions of tubes 20 and 20' and of tube shields 30 and 30' will vary depending upon the application.

As will also be appreciated by those of ordinary skill in the art, although lug 22 and slots 34 and 34' are shown as being substantially rectangular in shape, other configurations are possible. For example, lug 22 can be cylindrical in shape and slot 34 can be circular, while slot 34' can be substantially rectangular with its closed end being semicircular.

Modifications and variations of the above-described embodiments of the present invention are possible, as appreciated by those skilled in the art in light of the above teachings. For example, retaining means other than the straps can be used to maintain the shield member in place around the tube. One such retaining means is the U-bolt and bar of the prior art. A lug and slot in accordance with the present invention can also be applied to the snap system of the prior art. Further, the shield member can be provided with slots at both end, with a slot at one end and at an intermediate position, or with slots at both ends and at an intermediate position to provide a more universal application.

It is therefore to be understood that, within the scope of the appended claims and their equivalents, the invention may be practiced otherwise than as specifically described.

What is claimed is:

1. A tube and tube shield assembly comprising:
   - a cylindrical tube having a lug extending radially therefrom; and
   - a tube shield mounted on said tube, said tube shield including:
     - a semi-cylindrical shield member having a diameter substantially equal to that of sad tube, said shield member having a slot formed therein, said lug engaging said slot; and
     - retaining means for retaining said shield member in engagement around said tube.

2. The assembly of claim 1, wherein said shield member has an upper end and a lower end, and wherein said slot is formed extending inwardly of said lower end.

3. The assembly of claim 1, wherein said shield member has opposed ends, and wherein said slot is formed intermediate said ends.

4. The assembly of claim 1, wherein said retaining means comprises at least two U-shaped straps, each of said straps having opposed ends attached to said shield member.

5. The assembly of claim 1, wherein said retaining means comprises:
   - at least two U-bolts, each of said U-bolts having opposed ends extending around said shield member;
   - at least two elongated bars, each of said bars having holes therethrough for receiving said opposed ends of one of said U-bolts; and
   - fastening means for fastening each of said bars on one of said U-bolts.

6. A tube and tube shield assembly comprising:
   - a cylindrical tube having a lug extending radially therefrom; and
   - a cylindrical shield mounted on said tube, said tube shield including:
     - a semi-cylindrical shield member formed to cover more than one-half of the circumference of said tube and having when unmounted a radius slightly smaller than that of said tube, said shield member having a slot formed therein, said lug engaging said slot.

7. A tube shield for placement around a cylindrical tube having a lug extending radially therefrom, said tube shield comprising:

a metal semi-cylinder having a slot formed therein for engaging said lug; and retaining means for retaining said semi-cylinder in engagement around the tube, wherein said retaining means comprises at least two U-shaped straps, each of said straps having opposed ends attached to said semi-cylinder.

8. The tube shield of claim 7, wherein said semi-cylinder has an upper end and a lower end, and wherein said slot is formed extending inwardly of said lower end.

9. The tube shield of claim 7, wherein said semi-cylinder has opposed ends, and wherein said slot is formed intermediate said ends.

10. A tube shield for placement around a cylindrical tube having a lug extending radially therefrom, said tube shield comprising:

a metal semi-cylinder having a slot formed therein for engaging said lug; and retaining means for retaining said semi-cylinder in engagement around the tube, wherein said retaining means comprises:

at least two U-bolts, each of said U-bolts having opposed ends extending around said shield member;

at least two elongated bars, each of said bars having holes therethrough for receiving said opposed ends of one of said U-bolts; and fastening means for fastening each of said bars on one of said U-bolts.

11. The tube shield of claim 10, wherein said semi-cylinder has an upper end and a lower end, and wherein said slot is formed extending inwardly of said lower end.

12. The tube shield of claim 10, wherein said semi-cylinder has opposed ends, and wherein said slot is formed intermediate said ends.

13. A tube shield for mounting around a cylindrical tube having a lug extending radially therefrom, said tube shield comprising a metal semi-cylinder having a slot formed therein for engaging said lug, wherein said semi-cylinder is formed to cover more than one-half of the circumference of said tube and has when unmounted a radius slightly smaller than that of said tube.

14. The tube shield of claim 13, wherein said semi-cylinder has an upper end and a lower end, and wherein said slot is formed extending inwardly of said lower end.

15. The tube shield of claim 13, wherein said semi-cylinder has opposed ends, and wherein said slot is formed intermediate said ends.

* * * * *